US010624410B2

(12) United States Patent
Carr

(10) Patent No.: US 10,624,410 B2
(45) **Date of Patent: *Apr. 21, 2020**

(54) HEAD VENTILATION DEVICES, SYSTEMS AND RELATED METHODS

(71) Applicant: Stephen C. Carr, Murray, UT (US)

(72) Inventor: Stephen C. Carr, Murray, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/666,799

(22) Filed: Oct. 29, 2019

(65) Prior Publication Data

US 2020/0060376 A1 Feb. 27, 2020

Related U.S. Application Data

(63) Continuation of application No. 16/237,523, filed on Dec. 31, 2018, now Pat. No. 10,492,560.

(60) Provisional application No. 62/611,965, filed on Dec. 29, 2017.

(51) Int. Cl.

| | |
|---|---|
| ***A42C 5/04*** | (2006.01) |
| ***A42B 3/28*** | (2006.01) |
| ***A42B 1/00*** | (2006.01) |

(52) U.S. Cl.

CPC ..... *A42C 5/04* (2013.01); *A42B 1/008* (2013.01); *A42B 3/286* (2013.01)

(58) Field of Classification Search

CPC .. A42C 5/04; A42B 1/008; A42B 3/28; A42B 3/281; A42B 3/283; A42B 3/285; A42B 3/286; A42B 3/003

USPC ..... 2/171, 181, 181.2, 181.4, 181.8, 182.1, 2/181.6, 182.3, 182.4, 182.5, 182.7, 2/DIG. 1, DIG. 11

See application file for complete search history.

(56) References Cited

U.S. PATENT DOCUMENTS

| | | | | |
|---|---|---|---|---|
| 9,756,888 | B2 * | 9/2017 | Ku | A42B 1/24 |
| 10,492,560 | B2 * | 12/2019 | Carr | A42B 3/286 |

* cited by examiner

*Primary Examiner* — Anna K Kinsaul
*Assistant Examiner* — F Griffin Hall
(74) *Attorney, Agent, or Firm* — Bretton L. Crockett; TechLaw Ventures, PLLC

(57) ABSTRACT

The present disclosure is directed to head ventilation devices and systems. A shell which may be worn as a hat includes a gap along at least a portion of a user's hatline defined by one or more spacer assemblies. An airflow assembly disposed at an upper end of the shell and spaced apart from the user's scalp causes airflow through the gap and an upper opening to ventilate a user's head. Additional protection features for sun shading, inclement weather, and/or safety may also be included.

20 Claims, 6 Drawing Sheets

HEAD VENTILATION DEVICES, SYSTEMS AND RELATED METHODS

CROSS-REFERENCE TO RELATED APPLICATION

This application is a continuation of U.S. application Ser. No. 16/237,523, filed Dec. 31, 2018, which claims the benefit of U.S. Provisional Application No. 62/611,965, filed Dec. 29, 2017. The disclosures of each of these related applications are hereby incorporated by reference herein in their entireties, including but not limited to those portions that specifically appear hereinafter.

TECHNICAL FIELD

The present disclosure relates to head ventilation devices and systems.

BACKGROUND

There have been many attempts to use a fan to ventilate or cool a human head, typically by installing a fan under the crown of a hat worn on the head. However, simply circulating air around the head is insufficient to provide cooling, particularly in conditions of high humidity. For example, many helmets use a flexible band around the "hat line" that prevents airflow around the head and/or rely on contact with the upper portion of the scalp for stability. Such designs prevent evaporation of water from the head where it is most needed. Further, such known constructions often lack the ability to stay in place during extreme body motions or to provide sun protection. A system or device that allowed for true ventilation of the head while secured for placement during physical activity would be an improvement in the art. Such a system that was additionally able to provide meaningful sun protection would be a further improvement in the art.

SUMMARY

The present disclosure is directed to head ventilation systems and devices. A shell which may be worn as a hat includes a gap along at least a portion of a user's hatline defined by one or more spacer assemblies, which may be a corrugated, inclined band. An airflow assembly disposed at an upper end of the shell and spaced apart from the user's scalp causes airflow through the gap and an upper opening to ventilate a user's head. Additional protection features for sun shading, inclement weather, and/or safety may also be included.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

DETAILED DESCRIPTION

The disclosure extends to methods, systems, and products for head ventilation. In the following description of the disclosure, reference is made to the accompanying drawings, which form a part hereof, and in which is shown by way of illustration specific implementations in which the disclosure is may be practiced. It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
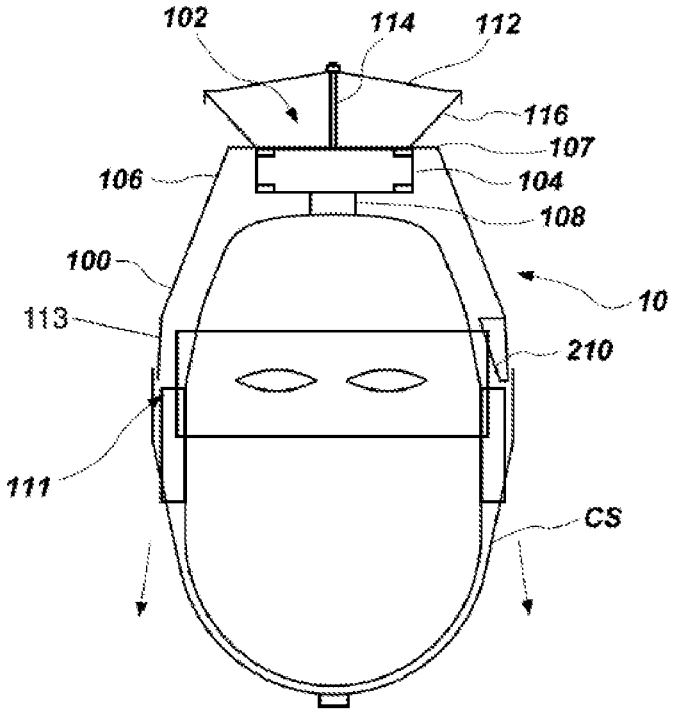
FIG. 1 is a sectional side view of a first embodiment of a head ventilation system in accordance with the teachings of the present disclosure, schematically showing some structural details thereof.
Figure 2A:
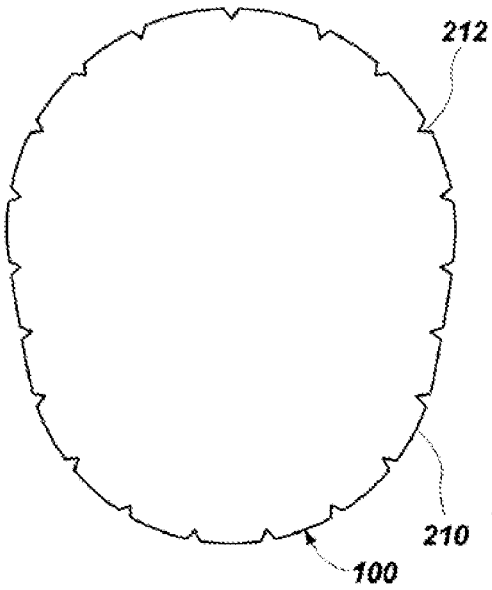
FIGS. 2A and 2B are cross-sectional views of the head ventilation system in accordance with embodiment of FIG. 1 taken at the lower end and at an upper end position of a corrugated headband component therein.
Figure 2B:
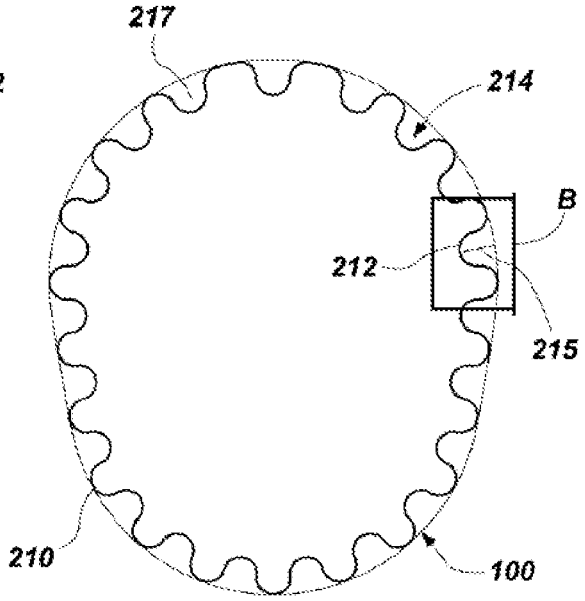
Figure 2C:
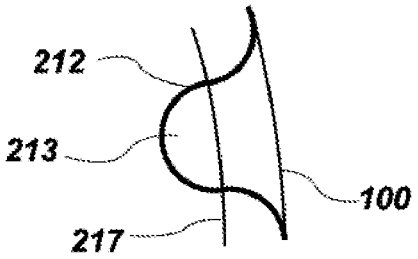
FIGS. 2C and 2D are sectional views of a typical flute section of the corrugated headband spacer component of FIGS. 2A and 2B.
Figure 2D:
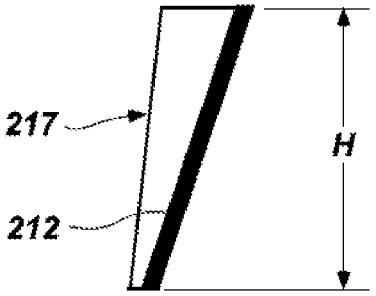

Turning to FIGS. 1 through 2D, a first embodiment of a head ventilation system 10 in accordance with the present disclosure is depicted. An outer shell 100 defines an enclosure around a user's head when the system 10 is worn as a hat. The outer shell may be constructed of a relatively rigid material that is impervious to air flow, to both hold its shape during use and to define a flow path. For example, polymeric and plastic materials that are relatively lightweight and can be formed into desired shapes by vacuum or injection molding may be used. The shell may have sidewalls that extend upwardly from a bottom edge defining a lower opening to an upper surface.

In the depicted embodiment, the surrounding sidewall of the shell 100 may have a relatively "straighter" or more vertical lower portion 113 extending from the lower edge to a line 105 encircling the shell 100. Above line 105, the shell 100 sidewall may taper inwardly as it rises to a planar upper surface 107. The taper of the sidewalls and size of shell 100 are designed to maintain an adequate flow space around the head of the user without being overly large. It will be appreciated that shells 100 having varying dimensions may be utilized for different users having differently sized heads.

An upper ventilation opening 102 may be disposed in the upper surface 107 of the shell 100 to allow airflow therethrough. As depicted, the opening 102 may be centrally disposed in the upper surface and may have a rounded shape, although this may differ for other embodiments. A protective screen 103 may be disposed over the opening to prevent inadvertent contact with fan assembly 104.

The fan assembly 104 is disposed underneath the upper ventilation opening and includes a powered fan for creating airflow, together with required control circuitry. A brushless DC motor (actually an AC motor with inverter electronics) may be used to power the fan. As depicted a single push-button 106 with a control circuit may be used to turn the fan on and off as well as to adjust the speed in increments with pulse width modulation. Power for the fan assembly 104 may be provided by batteries, such as rechargeable lithium batteries which can be mounted inside the shell 100 around the fan 104 or mounted off the head with an attached cable. A suitable electronic circuit may be used to ensure that the battery cells charge evenly. It will be appreciated that the fan assembly 104 may be used to create airflow in a desired direction. As a result, in some embodiments, airflow may be upwards in the system and in others may be downwards as may be suitable for different conditions.

A small resilient spacer 108 may be disposed beneath the fan assembly 104 to prevent contact of the assembly with a user's head and to help define the internal flow space above the user's head. The spacer 108 may be constructed from a resilient material to comfortably space the center of the fan outlet to the top of the scalp. The spacer 108 may be small and cylindrically shaped to minimize interference with the airflow.

As best depicted in FIGS. 2A through 2D, a corrugated hat band 210 may be disposed around the lower end of the shell 100 for contacting the head of the user and maintaining a flow space between the user's head and the internal sidewall of the shell 100. As depicted, corrugated hat band 210 may be disposed even with the user's hatline on the inner surface of the shell.

As depicted in FIG. 1, the corrugated hat band 210 may be installed in the shell 100 in the lower portion 113. The corrugated hat band 210 may extend from the lower edge of shell 100 to line 105 where the inward taper begins having a height indicated by H (FIG. 2D). In one illustrative embodiment, where the shell has a height of about 5.5 inches from the lower edge to the planar top 107, the line 105 may be disposed at a position about 1.5 inches from the lower edge. It will be appreciated that these dimensions are illustrative and may vary.

During use, the corrugated hat band 210 contacts the user's head to maintain a small gap between the shell 100 and the user's head. The corrugated hat band 210 may be defined by a series of tapered flutes that are formed along its length. Each flute 212 may be similar in shape. The particular number and spacing of each flute 212 in the plurality may vary, so long as the required airflow space is maintained.

One particular embodiment of a shape for an individual flute 212 that results in suitable airflow while providing a secure and comfortable fit on a user's head may be appreciated by reference to FIGS. 2A, 2B and 2C. Flute 212 tapers inwards from the shell 100 having a relatively smaller opening between the band 210 and the shell 100 at the lower edge, as shown in FIG. 2A, to a relatively larger opening therebetween at the upper edge, as shown in FIGS. 2B and 2C. The slope of a line at position 213 which is the furthest distance of the flute 212 from the shell 100 may be used to define the size of the flute 212. The flute 212 may symmetrically curve along its height from point 213 along an axis 215 towards the shell 100.

In the depicted embodiment, where the band 210 has a height of about 1.5 inches, at a lower edge point 213 may be at a position approximately ⅛ of an inch (or about 0.10 inches) from the shell 100, as depicted in FIG. 2A, and at the upper edge point 213 may be at a position approximately ½ of an inch (or about 0.50 inches) from the shell 100, as depicted in FIGS. 2B and 2C (which is an enlarged view of the box B in FIG. 2B). This may provide a 6-degree draft when measured from a midline 217 of the space 214 defined by the flute 212, as depicted in the cross-sectional view of FIG. 2D taken along line 215. It will be appreciated that these shapes and dimensions are merely illustrative and the other flute shapes and dimensions may be used as may be advantageous for a particular embodiment and can vary based on the size of the shell 100, the size of the intended user and the shape of the particular flute.

The ideal material characteristics for the corrugated hat band 210, as well as the number, and shape of flutes 212, are a compromise of effective air flow, comfort, width, and the ability to match some variations in head shape and sizes. Of course, a softer material tends to be more comfortable. One material that may be used is an ABS material.

To achieve acceptable cooling and ventilation, a sufficient number of flutes 212 must be present and spaced along the length of the inside of the annular opening between the shell 100 and the head (at the hat band location) to provide a decent gap that is open to airflow. It will be appreciated that where the hat band 210 is formed of a somewhat flexible material, not only will some cushioning be provided to the user, but a small range of head sizes could be accommodated by a single band 210. By using differently sized flutes 212 on different corrugated hatbands 210 for a single sized shell 100, a single shell size could accommodate some range of actual head sizes. It will be appreciated that in some embodiments, rather than being formed as a separate replaceable band 210, the band 210 could be integrally formed with shell 100 with flutes 212 formed as tapered inner flutes in the shell wall.

In practice, it has been found that use of a corrugated band 210 not only is comfortable because of the multiple contact points around the scalp (20 in the depicted embodiment), but that this design allows some range of head sizes to be accommodated with one size band. Larger user heads have the contact point between the head and the flute 212 lower down the flute 212. The other side of the band 210 has sufficient area between the flutes to contact the outer shell firmly and be attached thereto by solvent welding or suitable hardware.

Figure 3A:
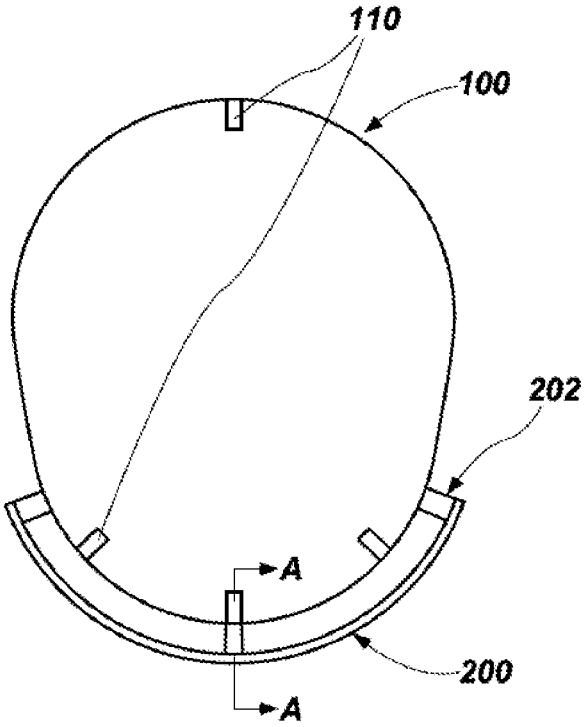
FIG. 3A is a cross-sectional view of the embodiment of FIG. 1 taken at the hatline.
Figure 3B:
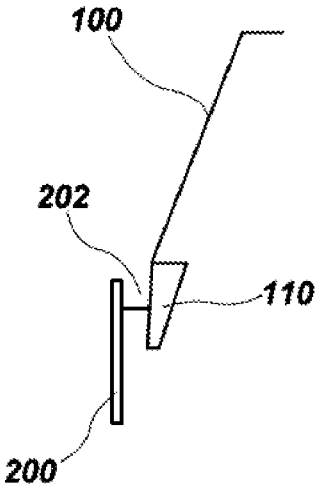
FIG. 3B is a sectional view taken along line AA in FIG. 3A.

Turning to FIGS. 3A and 3B, an alternative embodiment is depicted, where instead of the corrugated hat band 210 a plurality of small spacers are disposed around the lower end of the shell 100. As depicted, each small spacer 110 may be disposed even with the user's hatline on the inner surface of the shell. On installation, each spacer 110 contacts the user's head to maintain a small gap between the shell 100 and the head around at least a portion of the user's head. The ideal material characteristics for the spacers 110, as well as their number, and shape (between the hatline and shell 100), are a compromise of effective air flow, comfort, spacer width, and the ability to match some variations in head shape and sizes. Of course, a softer material tends to be more comfortable.

For maximum cooling and ventilation, most of the length of the inside of the annular opening between the shell 100 and the head (at the hat band location) should open to airflow with a decent gap 111 (at least of about 0.1 inches or more). This means that a number of small spacers 110 must be present to keep the shell 100 positioned properly. In the depicted embodiment, there are 4 spacers 110, each having a generally triangular shape, and formed of stiff plastic that is attached to the inside of the shell 100. It will be appreciated that by using different size spacers, a single shell size could accommodate some range of actual head sizes. To some extent, the spacers could be built into the shell 100 as tapered inner flutes. Further, any suitable number of spacers 110 could be used as long as the required gap 111 and airflow space are maintained.

Figure 4A:
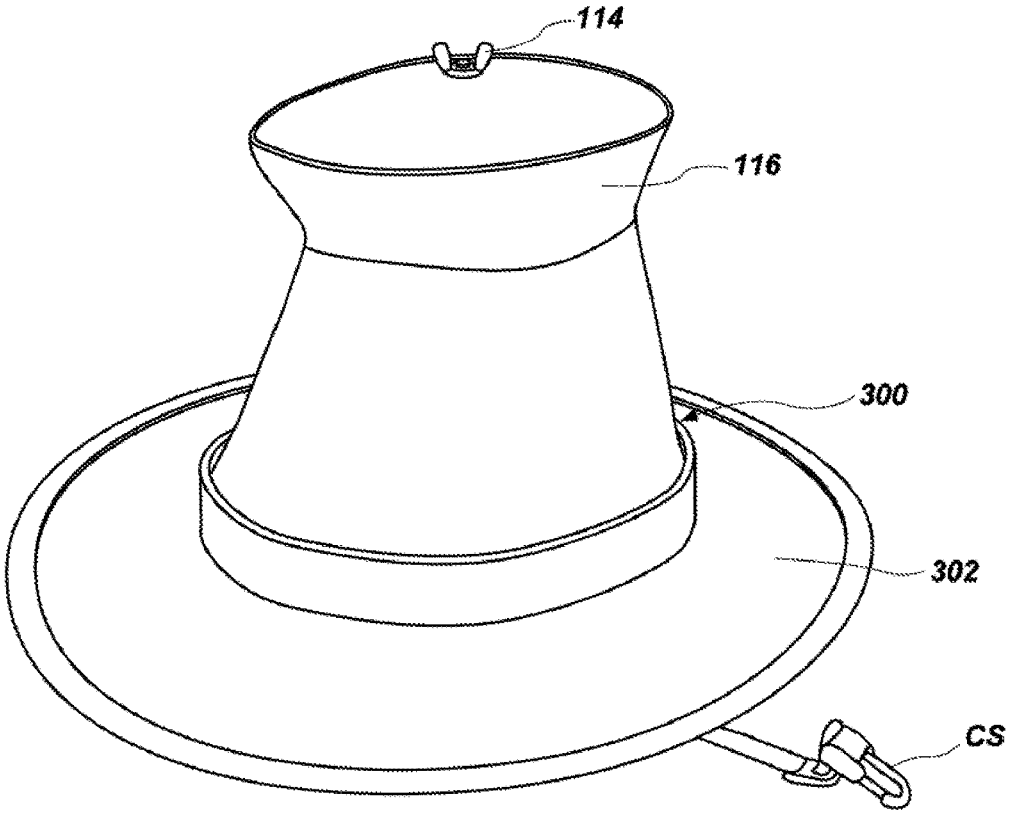
FIGS. 4A and 4B are perspective views of a covered head ventilation system and a shell for a head ventilation system, both in accordance with the teachings of FIG. 1.
Figure 4B:
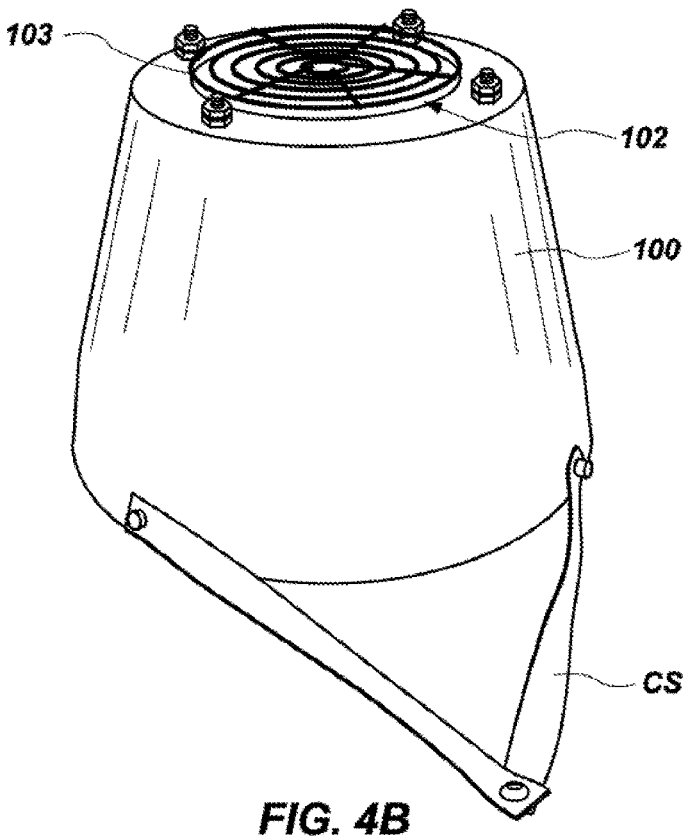
Figure 5A:
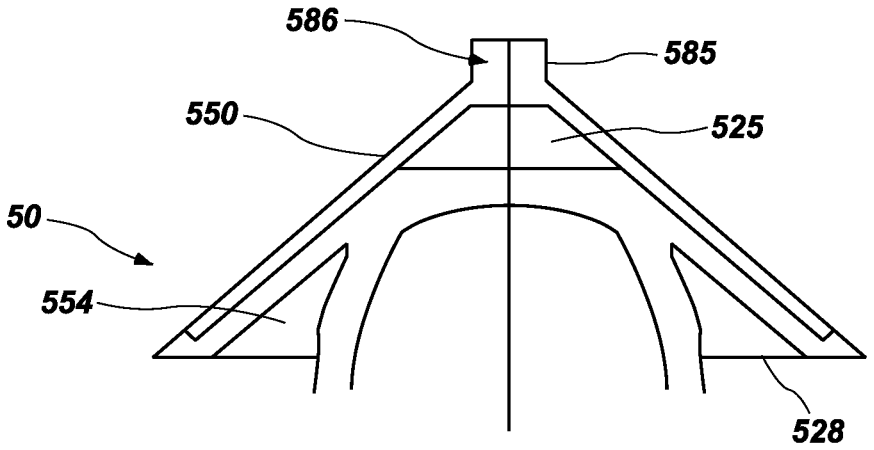
FIGS. 5A, 5B, and 5C are sectional side, enlarged sectional side of a portion, and bottom views of a solar powered embodiment of a head ventilation system in accordance with the teachings of the present disclosure, schematically showing some structural details thereof.
Figure 5B:
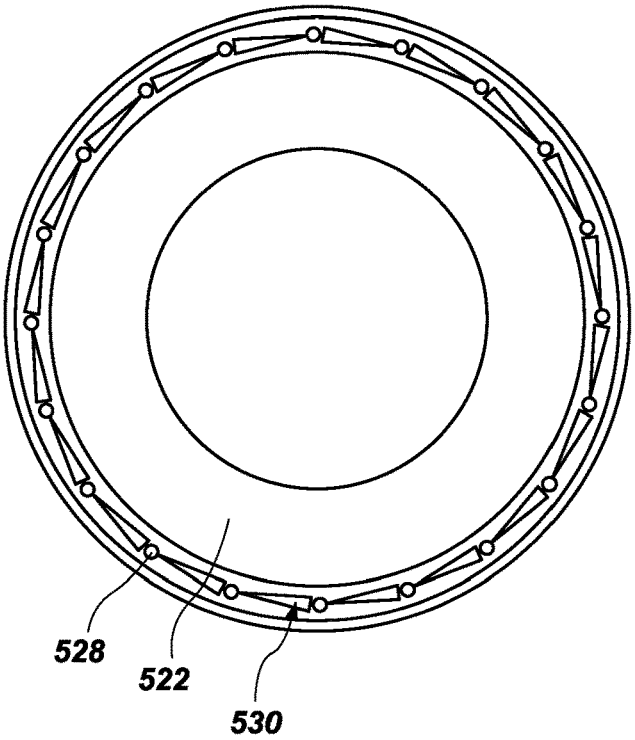
Figure 5C:
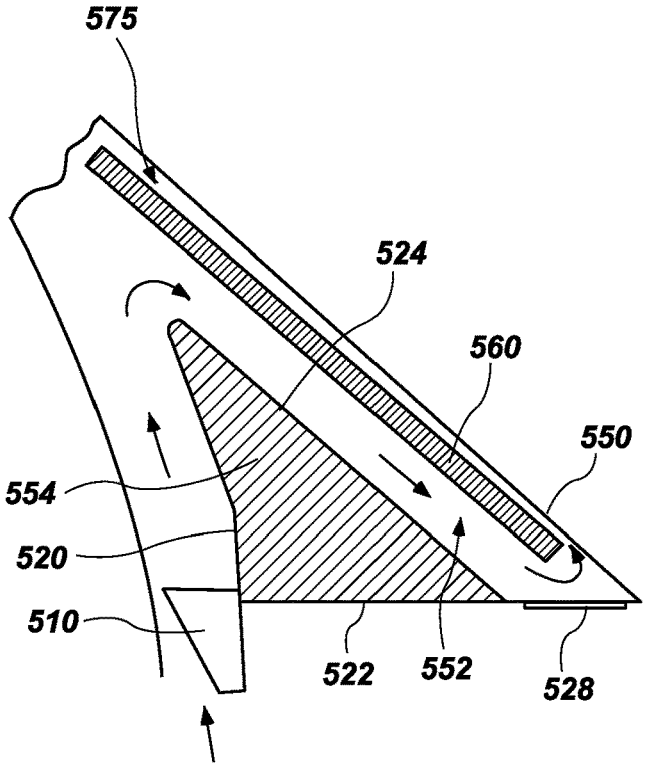
Figure 5D:
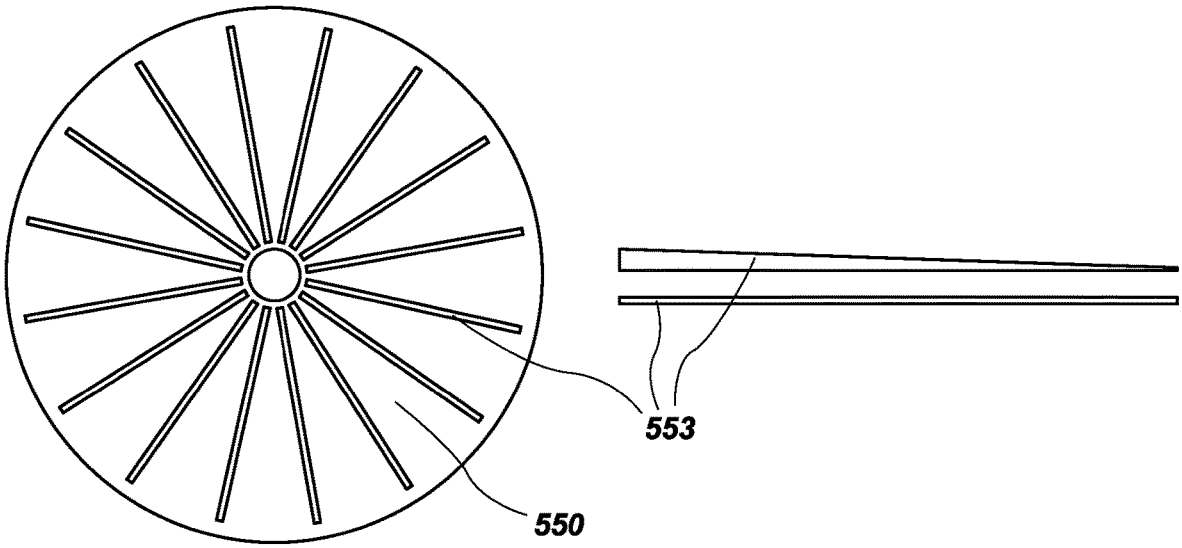
FIGS. 5D and 5E are top and side view of spacers used in the construction of the embodiment of FIGS. 5A through 5C.
Figure 5E:
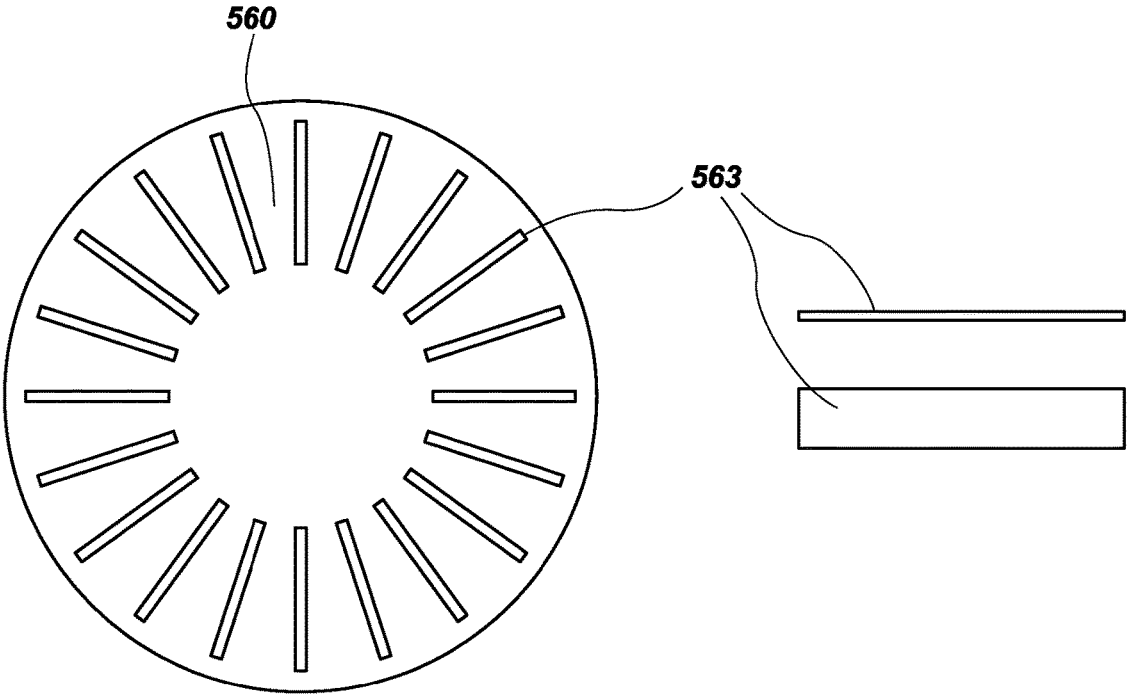

Above the upper surface of the shell 100, the opening 102 may be covered by a cap 112 that is spaced there above. As depicted, the cap 112 may be larger than the opening 102 and thus help shelter the opening 102 from rain or sun. The spacing may be maintained by a central shaft 114, by support columns, or as otherwise known in the art. The gap between the cap 112 edges and the shell 100 may be covered by a screen 116, which may form part of a cover 300 over the device, as depicted in FIG. 4A. Shell 100 may also include attachment points or spacer 202 for an eye shield 200 and for a chinstrap to maintain its position on a user's head.

As best depicted in FIG. 4A, the device 10 may include a cover 300. As depicted, cover 300 may be formed from a textile material and give the device 10 the appearance of a hat. A brim 302 may be used to provide shading to a user and complete the hat appearance. As shown, a porous textile may be used to form screen 116 as a portion of the cover 300. The screen may be as fine as mosquito netting, but is not a fine filter. The overall assembly could have a lower height if the rain/sun cap were increased in diameter and lowered so that the screen could be horizontal rather than at the depicted angle.

It will be appreciated that, the head ventilator 10 could be used with mosquito type netting and a drawstring on the neck. For safety use, it could be constructed as by an impact resistant helmet as long as the cross-sectional area for air inlet and outlet is maintained.

For use, the fan assembly may be actuated, and airflow generated through the upper opening 102 down around the scalp and out the gap 111, thereby cooling a user's head. Alternatively, the airflow may generate through the gap 111 upwards and around the user's scalp and out the upper opening to cool a user's head.

Turning to FIGS. 5A through 5E, another embodiment of a ventilator 50 which uses a solar heat inducer rather than an electric fan to create airflow is depicted. In this embodiment, the ventilator 50 may utilize a solar absorber to transfer the heat to a defined air flow path. The hotter air will have a lower density. This causes a low pressure so that air is pulled upward around a person's headline by the suction. As with the other discussed embodiments, a corrugated head band or spacers 510 are used to hold the ventilator away from a user's scalp and help define the flow path.

The upper surface 550 of ventilator 50 may be a sheet of material that is highly conductive to heat, such as a thin copper or aluminum sheet which has a flat black surface treatment. In one embodiment, it may be a copper or aluminum sheet of about 0.010 inches in thickness. Underneath the upper surface 550 is a tapered air space, generally indicated at 575, between the upper surface inner wall and an underlying cone of thin, high performance insulation with a metallized skin facing towards the aluminum. The space 575 may be maintained by a set of tapered spacers 553 arranged in a polar array. The spacers may be formed of a lightweight and relatively stiff material.

The underside of the insulator may be a plastic shell 560. In one embodiment, it may be constructed of ABS and have thickness of about 0.040". Supporting shell 560 is another set of radial spacers 563. Under shell 560 may be an annulus of lightweight foam 554 that is molded around the bottom of the basic head ventilator 50, to a horizontal disc 520, to a washer shape of plastic sheet on the bottom 522, and to an open cone shaped sheet on the sloped side 524. Depending on the type of foam, the two latter sheets may not be necessary. It will be appreciated that the separate spacers 553 and 563 may not be required where such features are molded in shell 560, rather than fabricated.

The bottom, washer shaped sheet 522, may have a multiplicity of holes 530 around the perimeter. Another very thin washer 528 of material may have matching quasi triangular holes. This washer serves as a slider valve when rotated slightly. Opening the valve serves to modulate the head ventilation airflow through space 552 as air is drawn downwards before entering space 575. A guide or groove to keep the slider in place, and some sort of handle attached to the slider may be included, but are not depicted.

Another truncated cone of foam 525 may be present to reduce the volume of space above the scalp and add rigidity. The top of the ventilator 50 may include a short tube 585 made of the conductive material (such as aluminum or copper) that leads to an upper opening 586. Tube 585 may add rigidity to the conductive sheet. A tethered plastic cap could be snapped over the end of the tube to protect against rain. The outermost portion of the brim where the conductive sheet of the upper surface meets a plastic sheet of the lower construction may be somewhat rounded and have an intervening heat resistant insulating material, such as silicon rubber, between the two sheets. This would prevent burning the fingers if touching the brim. The majority of the ventilator 50 as depicted is a symmetrical truncated cone. It will be appreciated that it need not be symmetrical about the vertical axis, nor do the sloping sides need to be flat.

Draft occurs as depicted in the space 552, and can be controlled by the washer slide valve 528 to shut off or restrict the ventilation without overheating of the conductive sheet 550. It will be appreciated that a throttling valve on the top air outlet 586 to modulate the draft could lead to higher temperatures that may be unacceptable.

In yet another potential design, wind could be used to facilitate ventilation with the use of a "wind turbine" at the top of a short pipe. This would be similar to the wind actuated vents on buildings and could provide ventilation when it is windy and humid but not enough sunshine to create a useful draft.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A head ventilation system comprising:

a shell defined by a sidewall surrounding a defined interior space, the shell extending upwards from an open bottom towards a top end;

a corrugated hat band disposed around an interior surface of the sidewall near a lower end of the shell and comprising a plurality of flutes that extend from a relatively smaller opening at a bottom end to a relatively larger opening, the corrugated hat band configured to contact a head of a user when the user's head is inserted into the open bottom to thereby define at least one gap between the sidewall and the head of the user;

an airflow space configured to be defined by the distance between the head of the user and the sidewall of the shell above the corrugated hat band; and an airflow assembly disposed such that when actuated the airflow assembly causes airflow through the at least one gap and the airflow space.

2. The head ventilation assembly of claim 1, wherein the airflow assembly is disposed at an upper end of the shell and configured to be spaced apart from the user's scalp.

3. The head ventilation assembly of claim 1, wherein the shell further comprises a closed top end and at least one upper opening disposed in the shell.

4. The head ventilation assembly of claim 1, wherein the airflow assembly is disposed such that when actuated the airflow assembly causes airflow through the at least one gap, the airflow space, and the at least one upper opening.

5. The head ventilation assembly of claim 4, wherein the airflow assembly comprises a powered fan assembly.

6. The head ventilation assembly of claim 4, wherein the airflow assembly comprises a solar collector that causes heated air to exit the at least one upper opening.

7. The head ventilation assembly of claim 6, wherein the solar collector comprises a sheet of thermally conductive material exposed on an upper surface of the airflow assembly and a tapered airspace underneath the thermally conductive sheet and in contact with the upper opening and the airflow space.

8. The head ventilation assembly of claim 7, further comprising a slider valve that allows airflow through the tapered airspace to be modulated by adjusting the size of a vent opening.

9. The head ventilation assembly of claim 1, wherein the corrugated hat band is configured to contact a head of a user when the user's head is inserted into the open bottom to thereby define a plurality of gaps between the sidewall and the head of the user.

10. The spacer assembly of claim 1, wherein each flute of the plurality of flutes tapers inward from the relatively smaller opening at the bottom end to the relatively larger opening at an upper end.

11. A head ventilation system comprising:

a rigid shell defined by a sidewall surrounding a defined interior space, the shell extending upwards from an open bottom to a top end;

a corrugated hat band disposed around an interior surface of the sidewall and comprising a plurality of angled flutes that extend from a relatively smaller opening at a bottom end to a relatively larger opening, the corrugated hat band configured to contact a head of a user when the user's head is inserted into the open bottom to thereby define at least a first lower airflow opening between the sidewall and the head of the user;

an airflow space configured to be defined around the head of the user by the sidewall above the corrugated hat band; and an airflow assembly disposed such that when actuated the airflow assembly causes airflow through the lower airflow opening and the airflow space.

12. The head ventilation system of claim 11, wherein the corrugated hat band is disposed around the interior surface of the shell at a lower end.

13. The head ventilation assembly of claim 11, wherein the rigid shell further comprises a closed top end and at least one upper opening disposed in the rigid shell.

14. The head ventilation assembly of claim 13, wherein the airflow assembly comprises a powered fan assembly disposed such that upon actuation it will cause airflow to enter through the lower airflow opening and flow through the airflow space to exit the upper opening.

15. The head ventilation system of claim 11, wherein each angled flute of the plurality of angled flutes is formed as a symmetrical curve in a relatively flexible material.

16. The head ventilation assembly of claim 11, further comprising a covering for the shell that includes a brim.

17. A spacer assembly for a head ventilation system, comprising:

a corrugated hat band configured to be disposed against an interior surface of a sidewall defining the head containing interior space of a head ventilation system to contact a head of a user when the user's head is inserted into the head ventilation system to thereby define at least a first airflow opening between the sidewall and the head of the user, the corrugated hatband comprising a plurality of angled flutes that extend from a relatively smaller opening at a bottom end to a relatively larger opening at an upper end.

18. The spacer assembly of claim 17, wherein each angled flute of the plurality of angled flutes is formed as a symmetrical curve in a relatively flexible material.

19. The spacer assembly of claim 17, wherein each angled flute of the plurality of angled flutes tapers inward from the relatively smaller opening at the bottom end to the relatively larger opening at the upper end.

20. The spacer assembly of claim 17, wherein the corrugated hat band is configured to contact a head of a user when the user's head is inserted into the open bottom to thereby define a plurality of gaps between the sidewall and the head of the user.

* * * * *